United States Patent [19]

Shirhall

[11] 4,000,905

[45] Jan. 4, 1977

[54] PRACTICE MAT FOR GOLFERS

[76] Inventor: Milan J. Shirhall, 6134 Montgomery Court, San Jose, Calif. 95135

[22] Filed: Sept. 24, 1975

[21] Appl. No.: 616,198

[52] U.S. Cl. ..... 273/187 A; 35/29 A

[51] Int. Cl.[2] ..... A63B 69/36

[58] Field of Search ..... 273/187, 183 A, 195 R, 273/195 A, 195 B, 196, 197 R, 197 A, 198; 35/29 A

[56] References Cited

UNITED STATES PATENTS

| | | | |
|---|---|---|---|
| 1,960,787 | 5/1934 | MacStocker | 273/187 A X |
| 2,150,580 | 3/1939 | Crowley | 273/187 R |
| 2,457,351 | 12/1948 | Crowley | 273/187 R |
| 2,606,026 | 8/1952 | Young | 273/187 R |
| 3,350,101 | 10/1967 | Bishop et al. | 273/187 R X |
| 3,408,750 | 11/1968 | McCollough et al. | 273/187 R X |

*Primary Examiner*—George J. Marlo
*Attorney, Agent, or Firm*—Gerald L. Moore

[57] ABSTRACT

A mat for guiding golfers in addressing the ball on which are indicated positions and angles for the feet, placement of the ball and guide lines to indicate the proper direction to be traversed by the club.

1 Claim, 3 Drawing Figures

PRACTICE MAT FOR GOLFERS

BACKGROUND OF THE INVENTION

Golf professionals and expert golfers are generally in agreement that a proper stance and a correct addressing of the ball are probably the most important physical aspects of the game. While each player may have individual characteristics concerning the stance, there still exist certain requirements necessary for hitting the ball in the direction desired and along a straight line. These requirements generally include the proper placement of the feet relative to the direction it is desired to hit the ball and also relative to the ball itself so that the club will properly contact the ball for both hitting the ball for distance and causing it to fly substantially along a straight line. Obviously a golfer must be able to hit the ball along a straight path before he can master the fine points of the game requiring intentional hooking and slicing.

In addition, if repetition is developed in the stance relative to the ball and in the addressing of the ball one will tend to develop the necessary muscles for a constant and proper swing. With very few exceptions the only opportunities for practicing and judging the swing of the individual are either on a driving range or during actual play. Even in actual play, there is not a repetition of the same shot but instead, one must shift from irons to woods to the putter, et cetera. Of course on the driving range one can practice repeatedly with a desired club but even in this circumstance there is little opportunity to judge each swing itself except for watching the flight of the ball. It is the purpose of this invention to provide a practice means which the golfer can use at home to both practice his golf swing and correctly judge his swing to develop a proper stance, address the ball and swing for effective playing of the game.

SUMMARY OF THE INVENTION

A golf practice device comprising a flat mat including indicia for placement of the ball, for properly aligning both feet relative to the ball and the direction desired to hit the ball and for proper angling of the feet for each type of golf club commonly used in playing.

DESCRIPTION OF THE INVENTION

Figure 1:
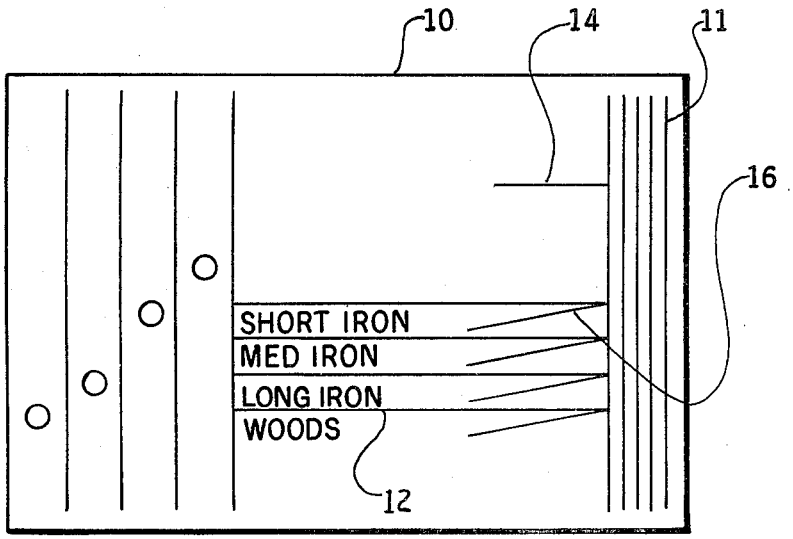
FIG. 1 is a plan view of the practice mat.

In FIG. 1 is shown the invention comprising a mat 10 which preferably is approximately 3 feet × 4 feet square. The mat is made to lay flat on the floor or ground and can most effectively be formed from a carpet material such as indoor-outdoor carpet. Preferably the top surface is colored green or other suitable color with the invention being embodied in the indicia and the manner of using the indicia on the mat.

The overall purpose of this invention is to provide a means for practicing the golf stance and swing with means to provide an indication of the effectiveness of the swing whether or not a golf ball is struck.

The purpose of the mat is to permit a golf player to stand on the mat and by placing or simulating placement of a ball at various points on the mat, there is further indicated the proper foot placement for the stance and effective addressing of the ball. Thereafter practice swings can be carried out with an immediate visual indication of the accuracy of the swing.

For the purpose stated there is provided a series of first parallel lines 11 along one edge of the mat to indicate proper placement of the heels of the player. A plurality of these lines is provided because players of different heights, arm lengths and lengths of clubs will call for different placements on the mat.

A series of second lines 12 extend perpendicular to the heel lines towards a position indicating the points of general placement of the balls. Actually use of the mat does not have to incorporate the hitting of actual balls, however it has been found effective at times to use the lightweight plastic balls in more confined areas. It is also practical to use the mat to hit actual golf balls on a driving range, but such is not at all necessary for effective use of the mat. Parallel to the series of lines 12 is a third line extending perpendicular to the heel lines to indicate proper alignment of the rearward or trailing foot of the player. In the instance of a righthanded player, the trailing foot is the right foot or the foot furthest away from the direction the ball is to be hit. In each case the direction of travel of the ball is indicated by the large arrow 15 in the drawings which arrow is not a part of the actual practice mat. The trailing foot line 14 indicates the proper alignment of the trailing foot and not necessarily the position of the foot since that position will vary as the stance of the player varies.

Originating from the point of intersection of the series of lines 12 and the heel lines 11 is a series of fourth lines 16 extending at an angle between the series of lines 12 and in the general direction of the intended flight of the ball. These lines indicate the proper alignment of the forward foot of the player which in the case of a righthanded player is the left foot.

Figure 2:
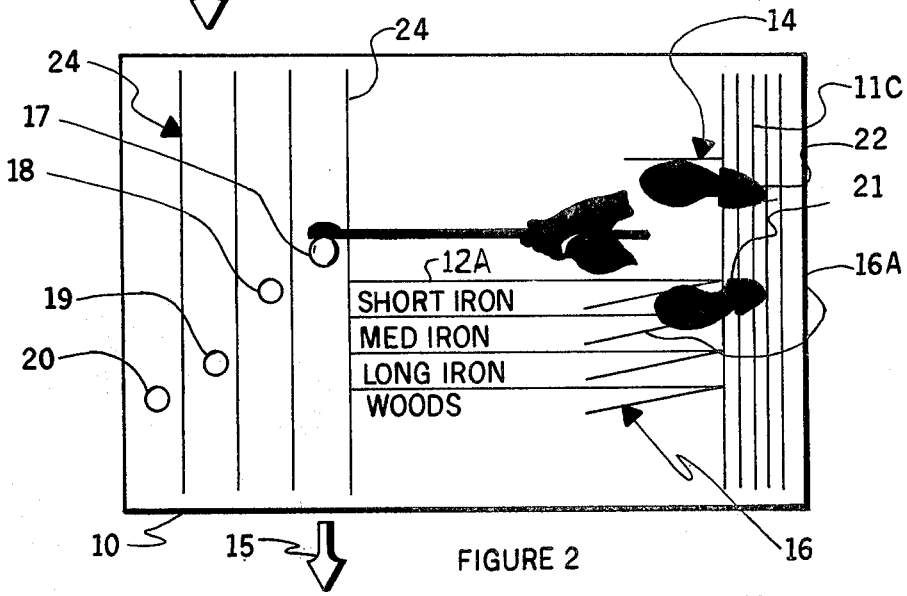
FIG. 2 shows the proper placement of the feet and ball on the mat for practicing short irons.

To illustrate use of the practice mat, in FIG. 2 is shown the stance of a player practicing short iron shots. The ball is placed on the marker 17 which is approximately two inches behind the short iron line 12A. The player selects a heel line for both heels for the proper spacing from the ball position corresponding to his height and places the left foot 21 adjacent to and parallel to the short iron line 16A on the mat. Thereafter by proper positioning of the rearward foot 22 parallel to the line 14 and tangent to the same heel line (heel line 11C in the illustration) the correct stance is complete. Thus the player is positioned facing the direction perpendicular to the intended direction of flight for the ball (arrow 15) and is guided each time in taking his position by the lines on the mat which have been selected as proper for his height. However the player will always utilize the line 16A for positioning of his leading foot and set his trailing foot parallel to the line 14. Thus the only variance between players will be the position of the trailing foot 22 relative to the line 14 and also the selection of the proper heel line from the series of lines 11. While in this position the player can practice swinging the golf club through the position 17 for the ball.

In accordance with another feature of the invention there is provided a series of fifth lines 24 extending parallel to the direction of intended flight of the ball. These lines are provided such that the player can visually determine if the flight of the club head is parallel to the direction intended for the ball. Of course if the flight is not in that exact direction, there will result a slice or hook on the ball because the club will come through the ball at an angle instead of approaching the ball from directly behind it. It has been found that a white piece of paper or other light marking means placed on the club will enable the player to visually observe the direction of club travel relative to these lines for a close study of the club head travel. Requiring the player to watch the club head path in this manner relative to the fifth series of lines also requires the player to keep his head down, a very important part of an effective golf swing.

Figure 3:
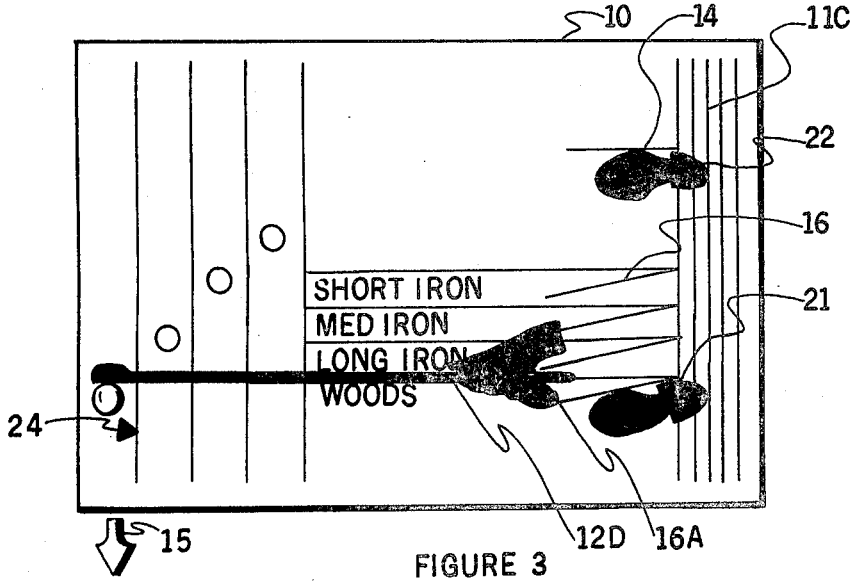
FIG. 3 shows the proper placement of the feet and the ball for practicing wood shots.

In FIG. 3 is illustrated the use of the practice mat for practicing wood swings. In this instance the player places the forward or leading foot 21 parallel and somewhat adjacent the forward line 16A of the fourth line series 16 and adjacent the heel line 11C which happens to be the proper position for the player'S reach and club length. Thereafter the trailing foot 22 is placed parallel to the trailing foot line 14 or under the right shoulder of the player while placing the club head adjacent the position 20 which is immediately to the right of the line 12D for the wood club practice. Once again the player is guided in the proper stance by positioning the feet parallel to the necessary guide lines in a comfortable stance to practice his swing while visually watching the traverse of the club head over the mat and relative to the fourth group of lines 24.

Thus it can be seen that there is provided a practice mat which not only instructs the player in the proper stance to assume for the correct addressing of the ball but also assures that each time the player will assume his stance in the same manner so that a proper golf swing will be repeated. Eventually sufficient practice will result in the player automatically assuming the proper position each time the ball is addressed with the body being forward or rearward relative to the second series of lines 12 depending upon whether woods or iron clubs are to be used. By constantly observing the travel of the club head the player is instantly alerted to any tendency to swing the club through the ball at an angle which during play will result in a hooking or slicing of the ball. While the procedure for using the mat and the mat indicia has been explained for use by a right-handed player, reversal of the indicia on the mat will enable a left-handed player to use the mat in the same manner.

The invention claimed is:

1. A golf practice mat for indicating the placement and alignment of the forward and rearward feet of the player, the placement of the ball and the direction of travel of the club head as the golf club is swung to hit the ball, including the following:

a mat for placement on the ground, said mat including the following indicia;

a series of first lines indicating heel placement of the player;

a series of second lines each having one end intersecting the nearest of the first lines and extending perpendicular thereto such that the other end thereof indicates the point of placement of the ball for different iron and wood shots with indicia adjacent each second line indicating the club to use with the associated line;

a plurality of positions marking the placement of the ball for various golf clubs;

a third line extending perpendicular to the series of first lines and generally towards the ball placement points and spaced from the second lines in the direction opposite to the direction of ball travel for indicating alignment of the rear foot of the player; and a plurality of fourth lines extending from the intersection of such of said second lines and said nearest of the first lines and generally towards said points of placement of the ball and the intended direction of travel of the ball to indicate alignment of the forward foot of the player; and a plurality of spaced fifth lines extending parallel to said first lines and passing through the areas of placement of the ball to indicate the direction of club head travel as the club is swung to hit the ball whereby the player can position his heels on a selected first line, align his forward and rearward feet relative to the fourth and third lines respectively and practice swinging at a ball on the placement points near the second line while observing the accurate travel of the club head along the fifth lines.

* * * * *